US006422053B1

(12) United States Patent
Greuel et al.

(10) Patent No.: US 6,422,053 B1
(45) Date of Patent: Jul. 23, 2002

(54) APPARATUS AND METHOD FOR FORMING A RETAINING RING ON A WHEEL FOR A RATCHET WRENCH

(75) Inventors: Billy R. Greuel, Waterford; Edward A. Haase, South Milwaukee, both of WI (US)

(73) Assignee: A&E Manufacturing Company, Racine, WI (US)

( * ) Notice: Subject to any disclaimer, the term of this patent is extended or adjusted under 35 U.S.C. 154(b) by 0 days.

(21) Appl. No.: 09/945,412

(22) Filed: Aug. 31, 2001

Related U.S. Application Data

(62) Division of application No. 09/516,109, filed on Mar. 1, 2000, now abandoned.

(51) Int. Cl.[7] ..... B21D 22/06
(52) U.S. Cl. ..... 72/397; 72/354.8; 29/893.34
(58) Field of Search ..... 72/396, 397, 354.8, 72/309, 308, 313, 312, 357, 403, 354.6; 76/114, 10; 29/893.34, 893.33

(56) References Cited

U.S. PATENT DOCUMENTS 160,967 A * 3/1875 Stetter ..... 264/DIG. 55
1,475,032 A * 11/1923 Shrum et al. ..... 138/96 T
2,027,922 A * 1/1936 McNaught ..... 72/325
2,500,835 A 3/1950 Lang
2,606,516 A * 8/1952 Raynes ..... 72/398
2,774,259 A * 12/1956 Caulkins ..... 72/341
4,748,875 A 6/1988 Lang
5,813,272 A * 9/1998 Gomi ..... 72/354.8

* cited by examiner

*Primary Examiner*—Daniel C. Crane
(74) *Attorney, Agent, or Firm*—Andrus, Sceales, Starke & Sawall, LLP

(57) ABSTRACT

A method of forming a ratchet wheel adapted to be disposed in at least one end of the ratchet wrench for engaging an element to be turned, includes the step of providing a wheel blank having a generally hollow, cylindrical body formed with a radially projecting rib located midway between an upper hub portion and a lower hub portion, the upper hub portion being integrally formed with an upstanding lip having a diameter equal to or slightly smaller than the diameter of the upper hub portion. The method also includes the step of bending the lip inwardly to form a retention ring adapted to engage the upper surface of the element to be turned and prevent the element from slipping through the wheel of the ratchet wrench.

3 Claims, 5 Drawing Sheets

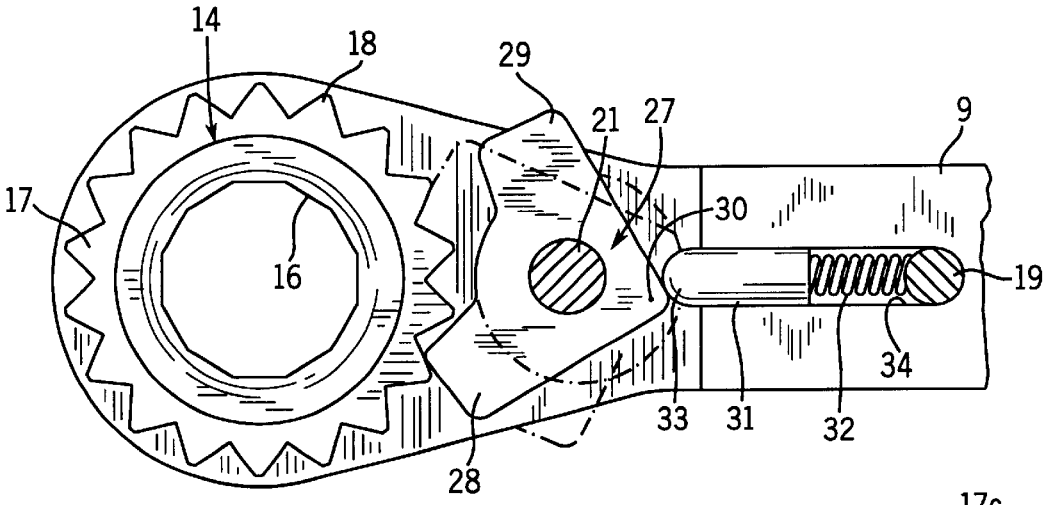
FIG.4A
PRIOR ART
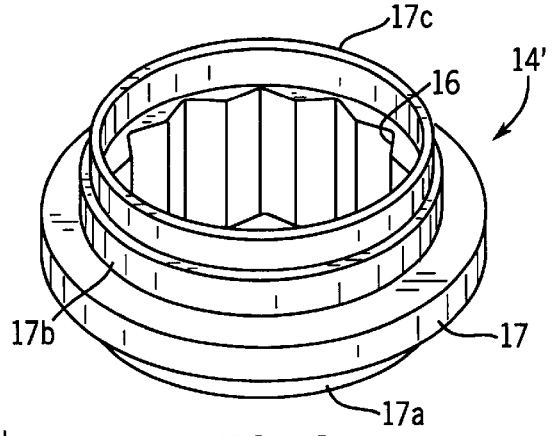
FIG. 6
FIG. 5
PRIOR ART
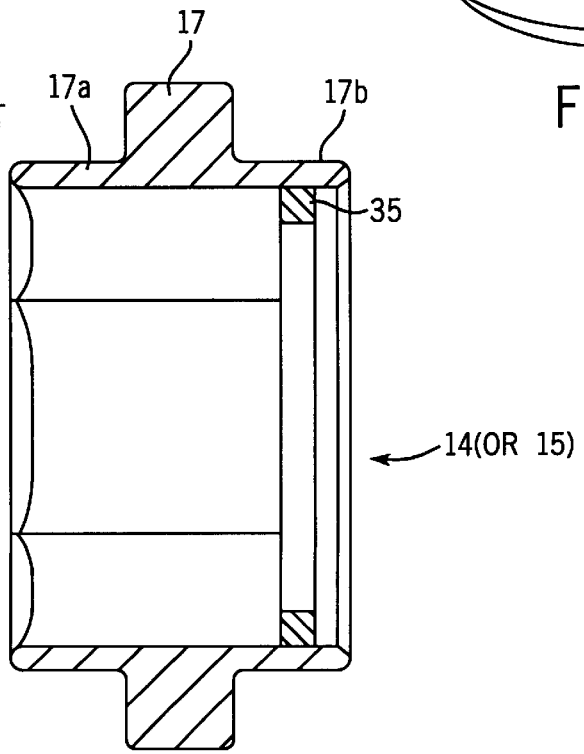

FIG. 10
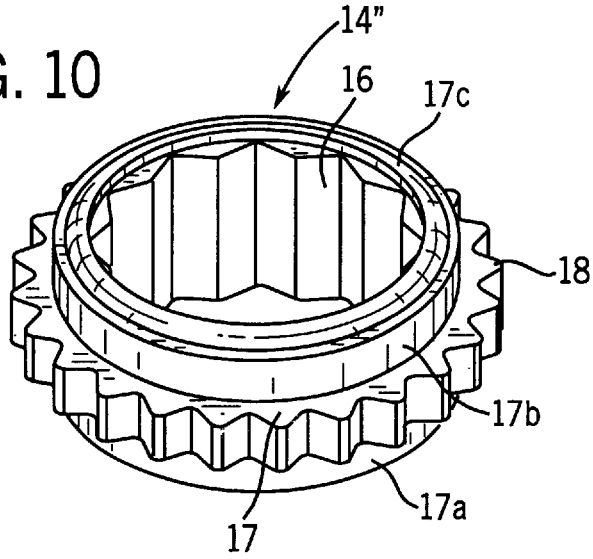
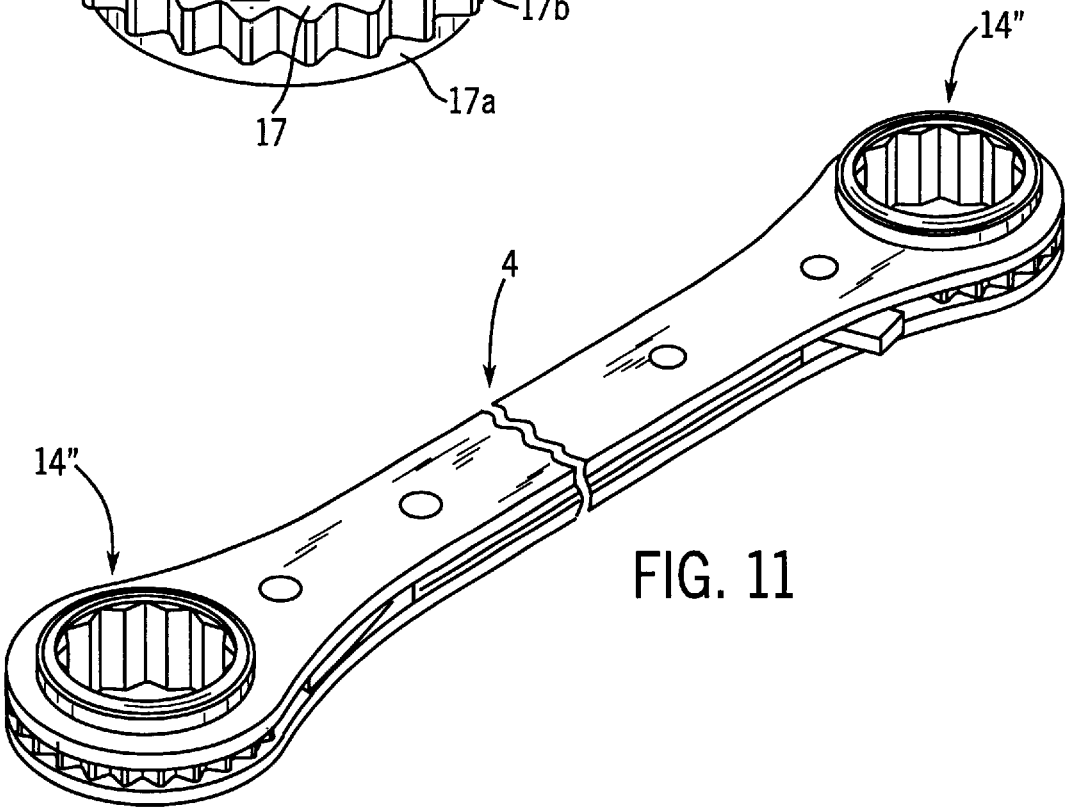
FIG. 11

APPARATUS AND METHOD FOR FORMING A RETAINING RING ON A WHEEL FOR A RATCHET WRENCH

This application is a division of Ser. No. 09/516,109, filed Mar. 1, 2000, now abandoned.

FIELD OF THE INVENTION

This invention relates generally to the manufacture of hand tools and, more particularly, pertains to an apparatus and method for forming a wheel blank of a ratchet wrench.

BACKGROUND OF THE INVENTION

Ratchet wrenches have been found to be extremely effective for tightening and loosening hex-headed fastening elements, such as bolts and machine screws, in a virtually endless range of applications. In this connection, ratchet wrenches have generally been found to be advantageous from a mechanical standpoint since they permit tightening or loosening operations to be carried out with oscillating motions which generally permit users thereof to apply maximum levels or torque to the heads of fastening elements while nevertheless minimizing the amount of work required to perform tightening or loosening operations. However, while ratchet-type wrenches have been found to have significant advantages over other types of wrenches, it has been found that they generally require a conscious effort to prevent slipping off of the fasteners being turned through the wrench wheel or socket engaged about the fastener.

For some years, the assignee of this application has produced ratchet wrenches which address the slipping problem by attaching a washer or retention ring to one side of the wrench wheel. Not only was this a difficult manufacturing process, but it was also inefficient and thereby costly as well.

It is desirable to provide a wrench wheel which will eliminate the need to reposition the ratchet wrench on the heads of fasteners or fittings during tightening and loosening operations. It is also desirable to provide an alternative manufacturing process and apparatus therefor for producing the wrench wheel. Furthermore, it is desirable to provide a ratchet wrench with improved performance and appearance.

SUMMARY OF THE INVENTION

One object of the present invention is the provision of a ratchet wrench wheel blank with an integral lip which is folded over in a two-stage bending process.

It is also an object of the present invention to provide an hydraulically operated apparatus for transforming a wheel blank into a rolled retention ring wheel used to improve the overall appearance of a ratchet wrench.

It is a further object of the present invention to provide a reversible ratchet wrench capable of selectively applying clockwise and counterclockwise torques to a polygonal body such as a bolt head or nut without repositioning the wrench thereon.

It is another object of the present invention to provide a ratchet wrench with a rolled wheel blank which facilitates non-slip engagement of a fitting or fastener head throughout tightening and loosening operations.

Another object of the present invention is to provide a ratchet wrench having a sparse number of total component parts.

Another object of the present invention is to provide a ratchet wrench of simplified design and low manufacturing cost.

Still another object of the present invention is to provide an improved ratchet wrench which is of durable and reliable construction and which is attractive to the buying public.

Still another object of the present invention is to provide a ratchet wrench with ends having a domed profile which adds to the aesthetics of the hand tool.

In one aspect of the invention, there is contemplated a method of forming a wrench wheel adapted to be disposed in at least one end of the wrench for engaging an element to be turned. The method includes the steps of providing a wheel blank having a generally hollow, cylindrical body formed with a radially projecting rib located midway between an upper hub portion and a lower hub portion, the upper hub portion being integrally formed with an upstanding lip; and bending the lip inwardly to form a retention ring adapted to engage the upper surface of the element to be turned and to prevent the element from slipping through the wheel of the wrench.

In another aspect of the invention, a ratchet wrench has opposed upper and lower plates defining a plate handle portion with at least one spacer separating the plates, the plates having integral head portions with apertures at the end of the handle portion for supporting and receiving about an axis of rotation sockets adapted to grasp an element to be tightened and loosened. A ratchet structure is provided for locking the sockets in one direction while permitting ratcheting movement in an opposite direction. The improvement resides in each of the sockets including an inwardly bent lip adapted to engage the element to be tightened and loosened in a manner which will prevent the element from slipping through the socket along its axis of rotation. This axis of rotation is generally perpendicular to the head portion of the ratchet wrench.

In another aspect of the invention, a wrench wheel forming apparatus includes supporting structure adapted to seat a generally cylindrical wheel blank having an upstanding lip. A lower forming structure is movable with respect to the supporting structure for initially bending the lip on the wheel blank. An upper forming structure is movable with respect to the supporting structure and the lower forming structure for completing inward bending of the lip of the wheel blank to form a retention ring thereon. The forming apparatus includes intermediate structure disposed between the lower forming structure and the upper forming structure for providing a resistive force therebetween and a guide path therefor. In addition, an actuator structure is provided for vertically moving the upper forming structure.

In yet another aspect of the invention, a wrench wheel forming apparatus includes a stationary pin locator having an upwardly extending locating pin adapted to seat a generally cylindrical wheel blank having an upstanding lip. A vertically movable punch holder having an upper end is adapted to be connected to a hydraulic ram and a lower end is provided with a downwardly depending punch. A vertically movable form insert retainer has a central bore into which the punch extends, the bore receiving a forming insert having a hollow interior in alignment with the bore. The punch holder and form insert retainer have aligned throughbores for accommodating the shoulder bolts which serve to guide the punch holder. A set of die springs surrounds the shoulder bolts and is interposed between a bottom of the punch holder and a top of the form insert retainer.

With this construction, at the beginning of a forming cycle, an upper portion of the forming insert is disposed immediately above the lip of the wheel blank, while the lower portion of the forming insert retainer and the forming insert are held slightly spaced from the stationary pin locator. In a first stage, a hydraulic ram is actuated to move the punch holder such that the die springs will exert a downward force on the form insert retainer enabling the upper portion of the forming insert to provide an initial inward bending of the lip as the lower portion of the forming insert contacts the pin locator and stops travel. In a second stage, the punch holder is moved further downwardly causing the punch to further bend the lip inwardly at a 90° as the punch bottoms against the locating pin. The upper portion of the forming insert includes a chamfered surface.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

The invention will become better understood by reference to the following description of the preferred exemplary embodiment when read in conjunction with the appended drawing wherein like numerals denote like elements, and:

FIG. 1 is a plan view of a prior art ratchet wrench;

FIG. 2 is a side view of a prior art ratchet wrench;

FIG. 3 is a plan view of a prior art ratchet wrench having the upper side or plate member removed;

FIG. 4 is a cross sectional view of the prior art ratchet wrench taken on line 4—4 of FIG. 3;

FIG. 4A is a fragmentary view of an alternative ratcheting mechanism for the prior art ratchet wrench;

FIG. 5 is a cross-sectional view of a retention ring wheel used in the prior art ratchet wrench;

FIG. 6 is a perspective view of a retention ring wheel blank;

FIG. 7 is a sectional view of a forming apparatus loaded with the wheel blank of FIG. 6;

FIG. 8 is a first forming stage for the wheel blank;

FIG. 9 is a second forming stage for the wheel blank;

FIG. 10 is a perspective view of a finished, rolled retention ring wheel formed in accordance with the present invention; and FIG. 11 is a perspective view of a ratchet wrench incorporating the finished, roll retention ring wheel in both ends thereof.

DETAILED DESCRIPTION OF THE INVENTION PRIOR ART

Figure 1:
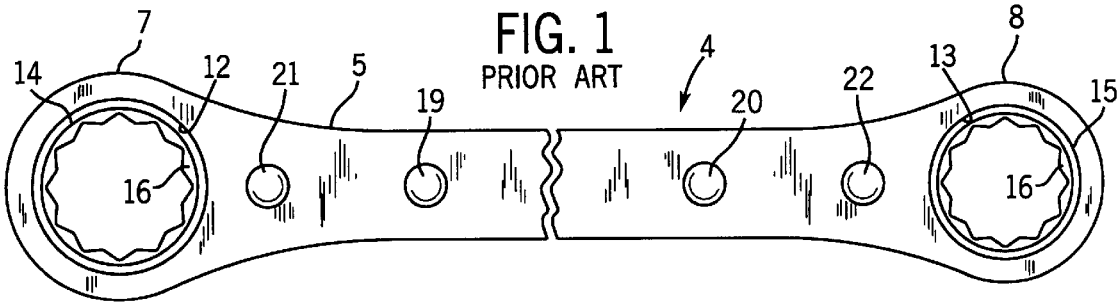
FIG. 1 PRIOR ART
Figure 2:
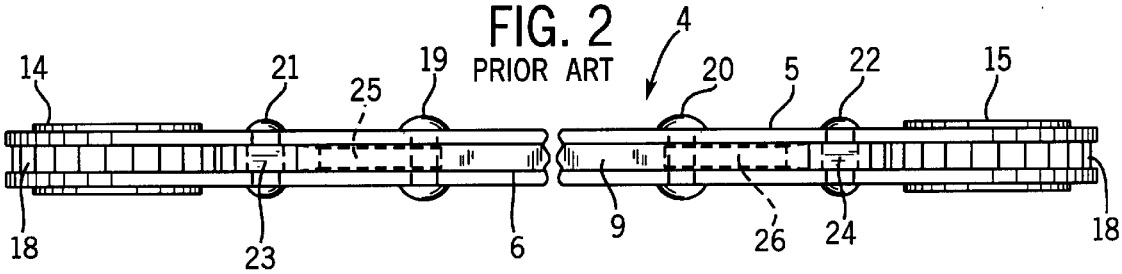
FIG. 2 PRIOR ART
Figure 3:
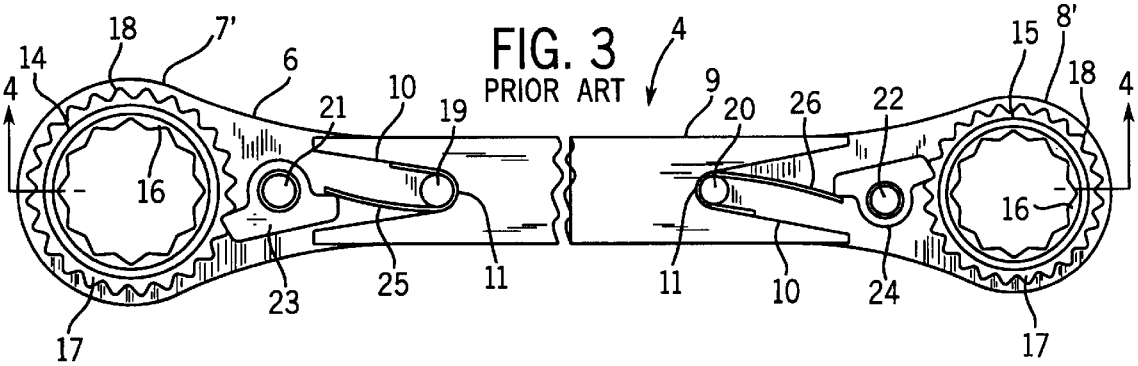
FIG. 3 PRIOR ART
Figure 4:
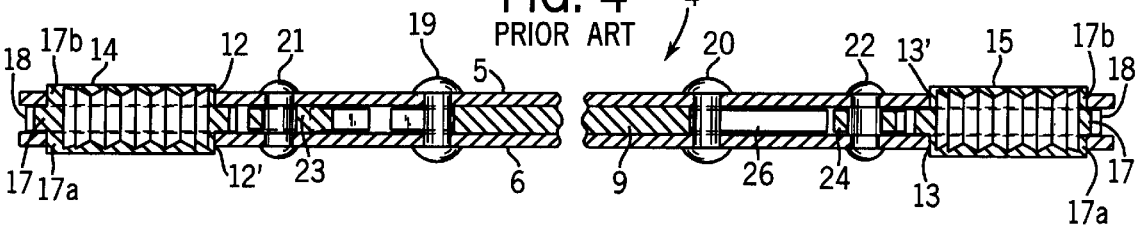
FIG. 4 PRIOR ART

Referring now to the drawings, FIGS. 1–4A illustrate a prior art ratchet wrench 4 constructed in accordance with expired U.S. Pat. No. 2,500,835. Wrench 4 includes an upper side member or elongated plate 5 and a lower side member or elongated plate 6 which together form a handle. The upper side member 5 is formed with an enlarged portion 7 at one end and with a similarly enlarged portion 8 at the opposite end. The lower side member 6 is formed with an enlarged portion 7' at one end and a similarly enlarged portion 8' at the opposite end. Disposed between the members 5 and 6 is at least one spacer bar 9 having a V-notch 10 at each end thereof. The apex of each V-notch 10 is preferably rounded as at 11.

The enlarged portions 7 of the member 5 and enlarged portions 7' of the member 6 contain identical apertures 12 and 12' respectively. The enlarged portion 8 of the member 5 and the enlarged portion 8' of the member 6 contain identical apertures 13 and 13 respectively. Rotatably supported in the apertures 12 and 12' is a generally cylindrical, hollow body in the form of a socket or wheel 14, and similarly disposed in apertures 13 and 13' is a socket or wheel 15. The interiors 16 of wheels 14 and 15 are preferably formed or broached with what is known as a twelve point construction, as is commonly used in box wrenches and socket wrenches, for engaging the periphery of a fastener to be turned. The wheels 14 and 15 are preferably of different sizes so that the interiors 16 of the respective wheels 14 and 15 accommodate different sizes of fittings or fastener heads. The wheels 14 and 15 are each formed with a peripheral flange or central rib 17 midway between a lower hub portion 17*a* and an upper hub portion 17*b* which are journaled in apertures 12,12', 13 and 13'. The periphery of each flange or rib 17 is formed with spaced, transverse ratchet notches 18, preferably having an angularity of approximately 90° between the faces thereof.

Extending transversely between the members 5 and 6 and transversely through the V-notches 10 near the rounded apex portions 11 thereof are rivets 19 and 20 connecting the plate members 5 and 6. The rivets 19 and 20 are positioned on the longitudinal axis of the plate members 5 and 6 and the heads of the rivets are formed as rounded surfaces. Also disposed on the longitudinal axis of the plate members 5 and 6, and-joining the plate members 5 and 6 together are rivets 21 and 22. Pivotally mounted on the rivets 21 and 22 are dogs 23 and 24 respectively, conforming to the shape of the V-notches 10 and extending around the rivets 19 and 20 respectively, are J-shaped, band springs 25 and 26. The extending portions of the springs 25 and 26 co-act with the inwardly projecting portions of the dogs 23 and 24 and force the outwardly projecting portions of the dogs 23 and 24 into engagement with the ratchet notches 18 of the wheels 14 and 15.

It is apparent from the above description and drawing that the sockets or wheels 14 and 15 will rotate in only one direction, each of the dogs 23 and 24 being forced into positive engagement with one of the notches 18 whenever rotation is stopped. The portions of the dogs 23 and 24 which engage the notches 18 are of such shape such that the engaging faces thereof contact substantially the entire face of one side of notch 18, thereby providing positive action. This engagement becomes more positive as force is exerted in an attempt to rotate the wheels 14 and 15 towards the dog (counterclockwise in FIG. 3).

However, it should be understood that, as seen in FIG. 4A, and as disclosed in expired U.S. Pat. No. 4,748,875, a reversible ratcheting mechanism is provided for both sockets 14,15 which includes a pawl 27 which is pivotally supported on the rivet 21 and which includes teeth 28 and 29 and a nose 30. The teeth 28 and 29 project from the outline of the handle 5,6 to afford manual manipulation to select the appropriate position of the pawl 27 for the desired torquing direction. With the pawl 27 in the solid line position shown in FIG. 4A, the tooth 28 will prevent clockwise rotation of the wheel 14 relative to the handle 5,6 to permit clockwise torquing, but will afford ratcheting or slipping of the handle relative to the wheel 14 in a counterclockwise direction to enable the user to restore the handle to the starting point for repeated torquing in the same direction within a limited arc.

The pawl 27 is retained in the selected position by a plunger 31 which is biased or urged outwardly by a spring 32 that is located between a plunger tip 33 and the rivet 19. The plunger 31 and spring 32 are confined in slots 34 in the spacer(s) 9. The plunger 31 can be depressed by manual manipulation of the pawl 27 to switch the pawl from one side to the other during ratcheting movement of the wrench handle, but is not depressed by torquing pressure on the wheel or socket 14 or 15 when pawl 27 is in the appropriate position.

In an effort to prevent the element being turned by wrench 4 from slipping through the wheel 14 or 15 along its axis of rotation, a separate element such as a washer 35 is attached within the inner periphery of upper hub portion 17*b*, as shown in FIG. 5. Because of the inclusion of washer 35, the wheel 14 or 15 may be referred to as a retention ring wheel. While this structure has provided the desired non-slip feature, it entails a difficult manufacturing process and is costly as well.

THE PRESENT INVENTION

In accordance with the invention, a new forming process involves providing a wheel blank 14', as shown in FIG. 6 with a ring-shaped extension or lip 17*c* integral to the upper hub portion 17*b*. The lip 17*c* forms a cylinder having a diameter which is equal to or slightly smaller than the diameter of the adjacent ring formed by hub portion 17*b*. The integral lip 17*c* is to be folded or bent over in a two-stage manner to provide the desired fastener retention previously satisfied by insertion of washer 35 in prior art wheel 14 or 15. No other additional attachment operations or parts are required.

Figure 7:
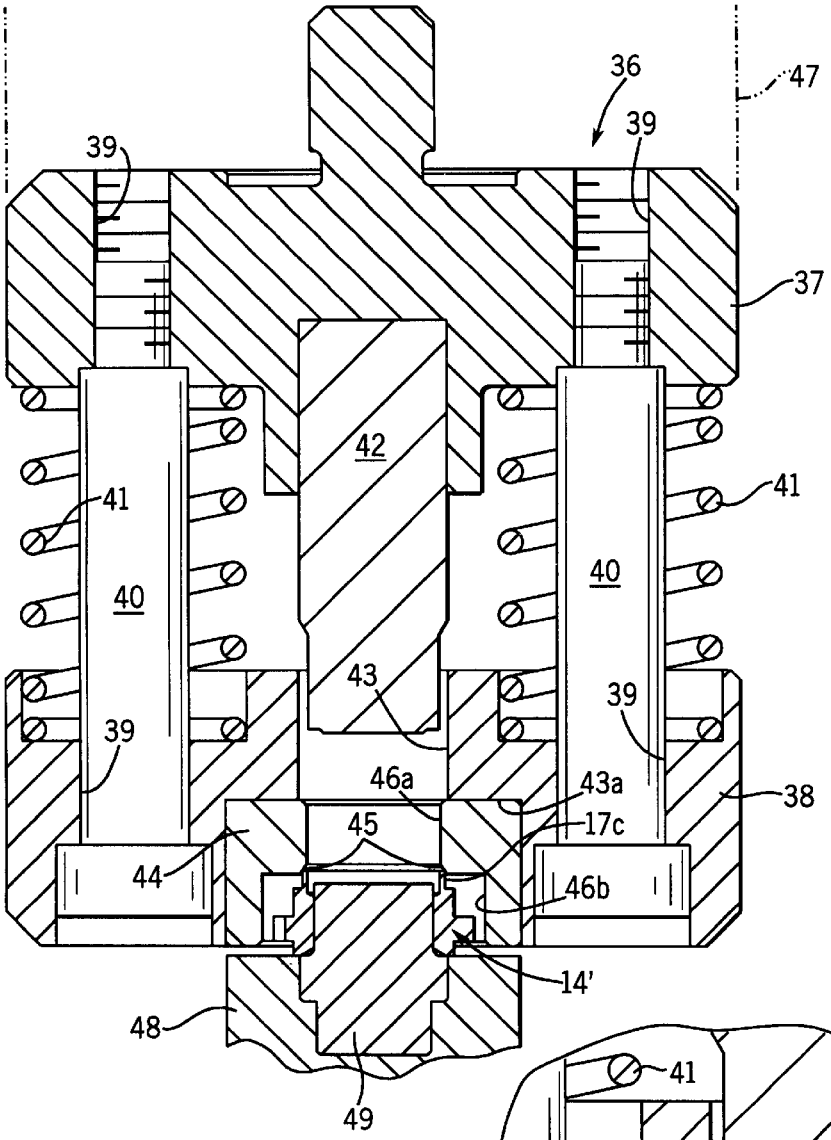

FIG. 7 shows a hydraulically-operated, forming apparatus 36 loaded with the wheel blank 14' of FIG. 6. The wheel blank 14' includes lower hub portion 17*a*, upper hub portion 17*b*, and lip 17*c* with the interior of the blank being broached as described above. The periphery or rib 17 is unmachined at this point. In the preferred embodiment, the wheel blank 14' is constructed of medium carbon steel. The forming apparatus 36 includes a punch holder 37 which is vertically movable with and relative to a form insert retainer 38. The punch holder 37 and form insert retainer 38 are provided with aligned throughbores 39 for accommodating a set of shoulder bolts 40 which serve to guide the punch holder 37. Four die springs 41 surround the shoulder bolts 40 and is interposed between the bottom of punch holder 37 and the top of form insert retainer 38. Punch holder 37 is centrally recessed to hold a substantially cylindrical forming punch 42 with a reduced size bottom end which tends downwardly into a center bore 43 cut in the form insert retainer 38. The center bore 43 is radially enlarged at 43*a* to receive a collar-like forming insert 44 having a chamfered surface 45 which is engageable with the lip 17*c* on wheel blank 14'. The forming insert 44 has a stepped interior void with an upper portion 46*a* into which the bottom of forming punch 42 projects, and a radially enlarged, lower portion 46*b* which accommodates the remainder of the wheel blank 14'. A hydraulic ram 47 is connected to the top of the punch holder 37 and is actuable to move the entire forming apparatus 36 upwardly and down-wardly relative to a stationary pin locator 48, including an upwardly extending locating pin 49 upon which the wheel blank 14' is seated.

Figure 8:
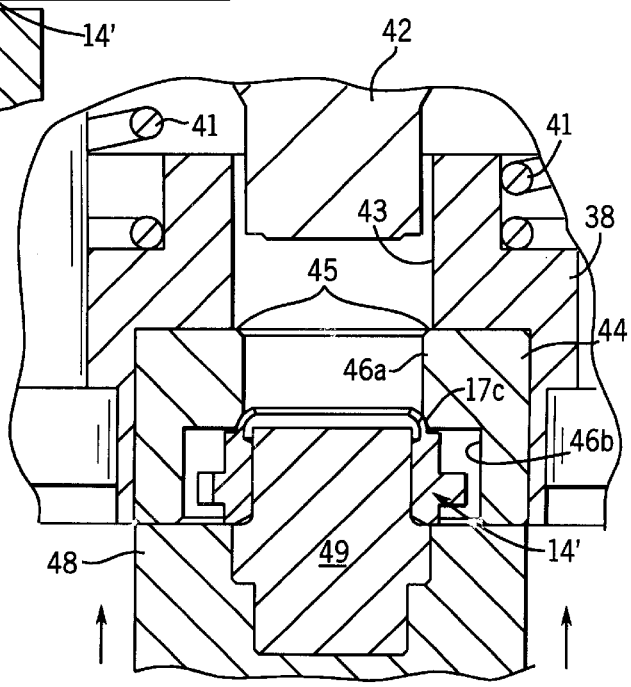
Figure 9:
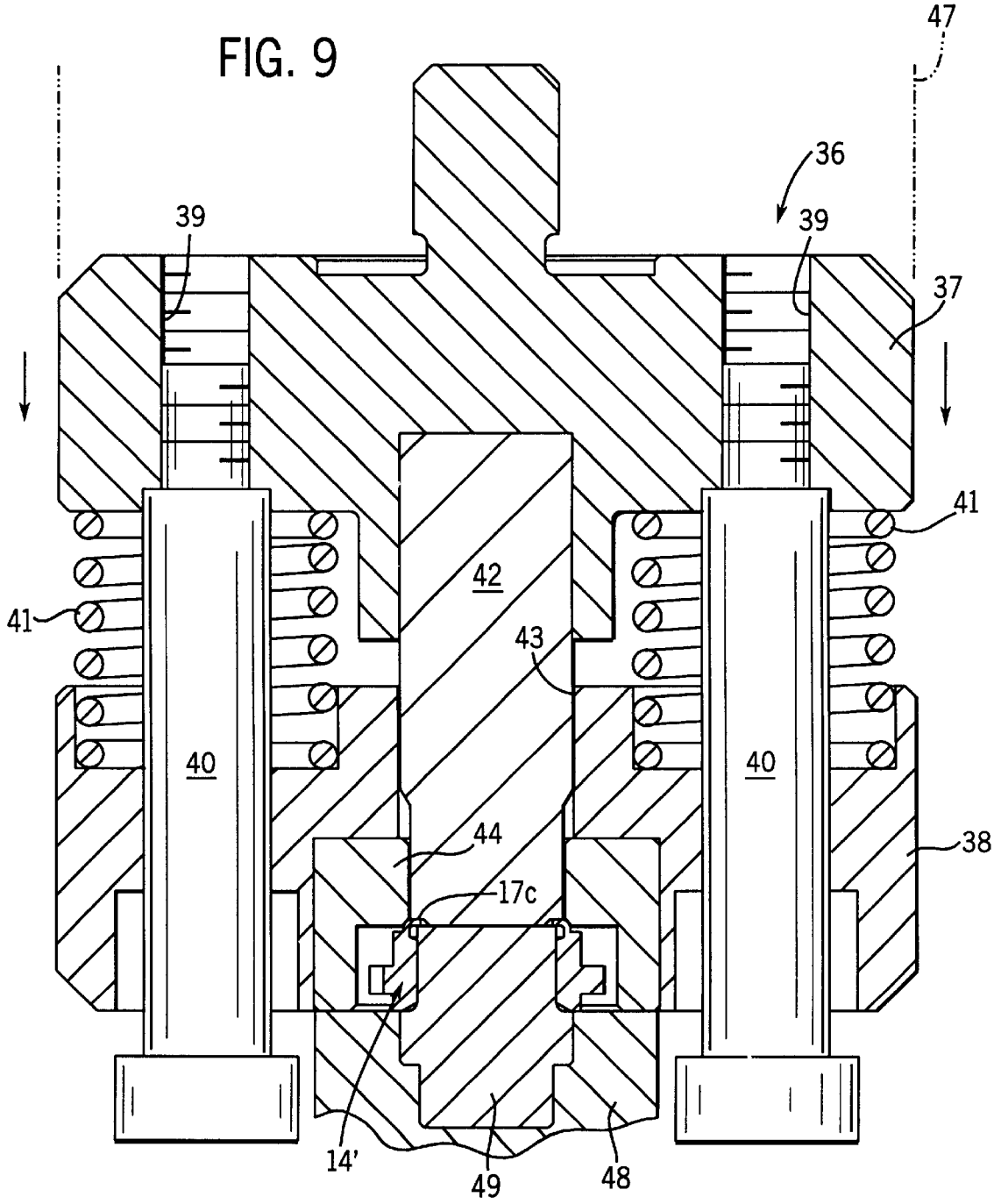

It should be understood that at the beginning of a forming cycle, the forming apparatus 36 is initially raised several inches above the stationary locating pin 49 in order to place the wheel blank 14' thereon. Then, the forming apparatus 36 is lowered to the position shown in FIG. 7, such that the chamfered surface 45 lies immediately above the uppermost extremity of the lip 17*c* and wheel blank 14', and the bottom of forming insert 44 is spaced a short distance above the top of the stationary pin locator 48. Next, the forming apparatus 36 is lowered slightly (FIG. 8) so that the die springs 41 will exert a downward force causing the chamfered surface 45 to apply an initial inward bending of the lip 17*c* on wheel blank 14', and also causing the forming insert 44 to bottom out on the pin locator 48. Continued hydraulic pressure moves the punch holder 37 and forming punch 42 downwardly against the spring pressure so that, as seen in FIG. 9, the bottom of the forming punch 42 coins or completes a 90° rolling over of the lip 17*c*. The punch 42 bottoms out on the head of the locating pin 49 and acts as a stop against further downward motion. After the lip 17*c* is folded over, the outer periphery of the rib 17 is separately machined to provide the ratchet notches 18. The finished socket or wheel is then ready for assembly into the wrench.

The process described provides a finished rolled retention ring wheel 14" (FIG. 10) which will not allow the fastener being turned by the wrench 4 to slip through the wheel 14 or 15 during use. This manufacturing process has proved to be more efficient and economical than methods involving the separate attachment of a retaining element to a wheel blank. It has been found that a single stage bending process of the lip 17*c* is not desirable because such method can compress and fracture the wheel blank 14'. The wrench produced with this manufacturing process provides a unique domed appearance, as seen in FIG. 11, which also adds to the aesthetics of the hand tool.

It should now be appreciated that the forming apparatus 36 includes supporting structure 48,49 adapted to seat a generally cylindrical wheel blank 14' having an upstanding lip 17*c*. Lower forming structure 38,44 is movable with respect to the stationary structure 48,49 for initially bending the lip 17*c* on the wheel blank 14'. Upper forming structure 37,42 is movable with respect to the supporting structure 48,49 and the lower forming structure 38,44 for completing inward bending of the lip 17*c* on wheel blank 14' to form a retention ring thereon. Intermediate structure 40,41 is disposed between the lower forming structure 38,44 and the upper forming structure 37,42 for providing a resistant force therebetween and a guide path therefor. Actuator structure 47 is provided for vertically moving the upper forming structure 37,42.

While the invention has been described with reference to a preferred embodiment, those skilled in the art will appreciate that certain substitutions, alterations and omissions can be made without departing from the spirit thereof. For example, although the preferred embodiment discloses the invention for use with a ratchet wrench, it should be understood that any type of wrench may utilize the apparatus and method for forming a retaining ring on a wheel or socket as described herein to prevent the slipping problem discussed in the Background of the Invention. Accordingly, the foregoing description is meant to be exemplary only and should not be deemed limitative on the scope of the invention set forth with the following claims.

We claim:

1. A wrench wheel forming apparatus comprising:

a stationary pin locator having an upwardly extending locating pin adapted to seat a generally cylindrical wheel blank having an upstanding lip;

a vertically movable punch holder having an upper end adapted to be connected to a hydraulic ram and a lower end provided with a downwardly dependent punch;

a vertically movable form insert retainer having a central bore into which the punch extends, the bore receiving a forming insert having a hollow interior in alignment with the bore;

the punch holder and form insert retainer having aligned throughbores for accommodating shoulder bolts which serve to guide the punch holders, and a set of die springs surrounding the shoulder bolts and interposed between a bottom of the punch holder and a top of the form insert retainer, whereby, at the beginning of a forming cycle, an upper portion of the forming insert is disposed immediately above the lip of the wheel blank while the lower portion of the form insert retainer and the forming insert are held slightly spaced from the stationary pin holder, in a first stage, a hydraulic ram is actuated to move the punch holder such that the die springs will exert a downward force on the form insert retainer enabling the upper portion of the forming insert to perform an initial inward bending of the lip as the lower portion of the forming insert contacts the pin locator and stops travel, and in a second stage, the punch holder is moved further downwardly causing the punch to further bend the lip inwardly at a 90° angle as the punch bottoms against the locating pin.

2. The apparatus of claim 1, wherein the upper portion of the forming insert includes a chamfered surface.

3. A wrench wheel forming apparatus comprising:

supporting structure adapted to seat a generally cylindrical wheel blank having an upstanding lip;

lower forming structure movable with respect to the supporting structure for initially bending the lip on the wheel blank;

upper forming structure movable with respect to the supporting structure and the lower forming structure for completing inward bending of the lip of the wheel blank to form a retention ring thereon;

intermediate structure disposed between the lower forming structure and the upper forming structure for providing a resistant force therebetween and a guide path therefor; and actuator structure for vertically moving the upper forming structure.

* * * * *